US008382868B2

(12) United States Patent
Goudemond et al.

(10) Patent No.: US 8,382,868 B2
(45) **Date of Patent: *Feb. 26, 2013**

(54) CUBIC BORON NITRIDE COMPACT

(76) Inventors: Iain Patrick Goudemond, Springs (ZA); Nedret Can, Boksburg (ZA); Stig Ake Andersin, Robertsfors (SE)

( * ) Notice: Subject to any disclaimer, the term of this patent is extended or adjusted under 35 U.S.C. 154(b) by 106 days.

This patent is subject to a terminal disclaimer.

(21) Appl. No.: 12/091,532

(22) PCT Filed: Oct. 27, 2006

(86) PCT No.: PCT/IB2006/003023

§ 371 (c)(1),
(2), (4) Date: Aug. 13, 2008

(87) PCT Pub. No.: WO2007/049140

PCT Pub. Date: May 3, 2007

(65) Prior Publication Data

US 2009/0293370 A1 Dec. 3, 2009

(30) Foreign Application Priority Data

Oct. 28, 2005 (ZA) ..... 2005/08766

(51) Int. Cl.
*C09K 3/14* (2006.01)
*B24D 3/04* (2006.01)

(52) U.S. Cl. ..... 51/309; 51/307; 51/308

(58) Field of Classification Search ..... 51/307, 51/308, 309

See application file for complete search history.

(56) References Cited

U.S. PATENT DOCUMENTS

| | | | | |
|---|---|---|---|---|
| 3,136,615 | A * | 6/1964 | Wentorf, Jr. et al. | 51/307 |
| 3,233,988 | A * | 2/1966 | Wentorf, Jr. et al. | 51/307 |
| 3,767,371 | A * | 10/1973 | Wentorf, Jr. et al. | 51/307 |
| 4,807,402 | A | 2/1989 | Rai | |
| 6,316,094 | B1 | 11/2001 | Fukaya et al. | |
| 6,319,460 | B1 * | 11/2001 | Fang | 419/32 |
| 2004/0002418 | A1 | 1/2004 | Scurlock et al. | |
| 2005/0143252 | A1 | 6/2005 | Okamura et al. | 501/96.4 |
| 2005/0187093 | A1 * | 8/2005 | McHale et al. | 501/96.4 |
| 2007/0184973 | A1 | 8/2007 | Lockemeyer et al. | |
| 2009/0177016 | A1 | 7/2009 | Lockemeyer et al. | |

FOREIGN PATENT DOCUMENTS

| | | | |
|---|---|---|---|
| EP | 0 974 566 | A | 1/2000 |
| EP | 1 043 410 | A | 10/2000 |
| GB | 2 335 440 | A | 9/1999 |
| JP | 4001002 | | 1/1992 |
| JP | 2000-044347 | A | 2/2000 |
| JP | 2000-247746 | A | 9/2000 |
| JP | 2000247746 | | 9/2000 |
| JP | 2000-319705 | A | 11/2000 |
| JP | 2005-518276 | A | 6/2005 |
| WO | WO 03/072246 | A | 9/2003 |

OTHER PUBLICATIONS

English translation of official action from Japanese Patent Office dated Dec. 9, 2011 for corresponding JP application 2008-537223.

English translation of official action from Japanese Patent Office dated Jun. 29, 2012 for corresponding JP application 2008-537223.

* cited by examiner

*Primary Examiner* — Elizabeth Wood

(74) *Attorney, Agent, or Firm* — Frommer Lawrence & Haug LLP; Ronald R. Santucci

(57) ABSTRACT

A method of making polycrystalline CBN compacts, high in CBN content, is provided. The method includes making a powdered composition by subjecting a mixture of CBN, present in an amount of at least 80 volume percent of the mixture, and a powdered binder phase to attrition milling. This powdered mixture is subjected to conditions of elevated temperature and pressure suitable to produce CBN compacts.

14 Claims, No Drawings

CUBIC BORON NITRIDE COMPACT

This application is a 371 of PCT/IB2006/003023 filed on Oct. 27, 2006, published on May 3, 2007 under publication number WO 2007/049140 A and claims priority benefits of South African Patent Application No. 2005/08766 filed Oct. 28, 2005, the disclosure of which is hereby incorporated by reference.

BACKGROUND OF THE INVENTION

This invention relates to the manufacture of polycrystalline cubic boron nitride abrasive compacts.

Boron nitride exists typically in three crystalline forms, namely cubic boron nitride (CBN), hexagonal boron nitride (hBN) and wurtzitic cubic boron nitride (wBN). Cubic boron nitride is a hard zinc blende form of boron nitride that has a similar structure to that of diamond. In the CBN structure, the bonds that form between the atoms are strong, mainly covalent tetrahedral bonds. Methods for preparing CBN are well known in the art. One such method is subjecting hBN to very high pressures and temperatures, in the presence of a specific catalytic additive material, which may include the alkali metals, alkaline earth metals, lead, tin and nitrides of these metals. When the temperature and pressure are decreased, CBN may be recovered.

CBN has wide commercial application in machining tools and the like. It may be used as an abrasive particle in grinding wheels, cutting tools and the like or bonded to a tool body to form a tool insert using conventional electroplating techniques.

CBN may also be used in bonded form as a CBN compact, also known as PCBN. CBN compacts tend to have good abrasive wear, are thermally stable, have a high thermal conductivity, good impact resistance and have a low coefficient of friction when in contact with a workpiece.

Diamond is the only known material that is harder than CBN. However, as diamond tends to react with certain materials such as iron, it cannot be used when working with iron containing metals and therefore use of CBN in these instances is preferable.

CBN compacts comprise sintered polycrystalline masses of CBN particles. When the CBN content exceeds 75 percent by volume of the compact, there is a considerable amount of CBN-to-CBN contact and bonding. When the CBN content is lower, e.g. in the region of 40 to 60 percent by volume of the compact, then the extent of direct CBN-to-CBN contact and bonding is less.

CBN compacts will generally also contain a binder containing one or more of phase(s) containing aluminium, silicon, cobalt, nickel, titanium, chromium, tungsten and iron.

A further secondary hard phase, which may be ceramic in nature, may also be present. Examples of suitable ceramic hard phases are carbides, nitrides, borides and carbonitrides of a Group 4, 5 or 6 transition metal, aluminium oxide, and mixtures thereof.

The matrix is defined to constitute all the ingredients in the composition excluding CBN.

CBN compacts may be bonded directly to a tool body in the formation of a tool insert or tool. However, for many applications it is preferable that the compact is bonded to a substrate/support material, forming a supported compact structure, and then the supported compact structure is bonded to a tool body. The substrate/support material is typically a cemented metal carbide that is bonded together with a binder such as cobalt, nickel, iron or a mixture or alloy thereof. The metal carbide particles may comprise tungsten, titanium or tantalum carbide particles or a mixture thereof.

A known method for manufacturing the polycrystalline CBN compacts and supported compact structures involves subjecting an unsintered mass of CBN particles, to high temperature and high pressure conditions, i.e. conditions at which the CBN is crystallographically stable, for a suitable time period. A binder phase may be used to enhance the bonding of the particles. Typical conditions of high temperature and pressure (HTHP) which are used are temperatures in the region of 1100° C. or higher and pressures of the order of 2 GPa or higher. The time period for maintaining these conditions is typically about 3 to 120 minutes.

The sintered CBN compact, with or without substrate, is often cut into the desired size and/or shape of the particular cutting or drilling tool to be used and then mounted on to a tool body utilising brazing techniques.

High CBN materials (also known as PCBN) are used mainly in machining applications such as grey cast iron, powder metallurgy (PM) steels, high chromium cast irons, white cast irons and high manganese steels. High CBN materials are used normally in roughing and heavy interrupted machining operations. In certain cases they are also used in finish machining, such as finish machining of grey cast iron and powder metallurgy (PM) irons.

Such a wide application area for PCBN places a demand for a material that has a high abrasion resistance, high edge integrity, high strength, high toughness, and high heat resistance. These combinations of properties can only be achieved by a material that has high CBN content, at least 75 volume % and a binding phase that will form a high strength bond with CBN.

Because CBN is the most critical component of the high CBN material which provides hardness, strength, toughness, high thermal conductivity, high abrasion resistance and low friction coefficient in contact with iron bearing materials, the main function of the binder phase is to cement the CBN grains in the structure and complement CBN properties in the composite. Therefore, the weaker link in the high CBN composite design is the binder phase as compared to CBN.

U.S. Pat. No. 6,316,094 and EP 1,043,410 both describe methods of making polycrystalline CBN compacts which contain a low, i.e. less than 70 volume percent, CBN content. These CBN compacts differ materially from compacts of this invention in both overall cBN content and in the function or role of the non-cBN matrix. It is well known in the art that high and low CBN content materials are fundamentally different from one another—evidenced by their use in widely divergent applications.

Low CBN content compact matrix material will include both a secondary hard phase and a binder phase, where the secondary hard phase is the dominant material in the matrix. For these compacts, the matrix phase (particularly the secondary hard phase) plays a significant role in determining, in and of itself, the performance of the compact in application. This matrix phase will be present in sufficient quantity (greater than 30 volume percent) to be continuous in two dimensions. In some examples in the patents cited above, the secondary hard phase, binder phase and CBN are subjected to attrition milling. The purpose of this milling is the reduction in size of the brittle secondary hard phase material and the homogenous dispersion of the binder, secondary hard phase particles and CBN particles.

In high CBN content polycrystalline compacts, the CBN plays the dominant role in determining performance in the application. The role of the matrix is chiefly to facilitate reaction bonding between CBN particles, hence cementing them together. The higher CBN content and required formation of a strong cementing bond necessitates that the matrix mixture in high CBN content compacts contains far higher relative quantities of ductile binder phase material. The compact may still contain some level of secondary hard phase material.

SUMMARY OF THE INVENTION

According to the present invention, a method of making a powdered composition suitable for the manufacture of a polycrystalline CBN compact includes the step of subjecting a mixture of CBN, present in an amount of at least 80% by volume of the mixture, and a powdered binder phase to attrition milling.

The powdered mixture, after the attrition milling, and, where necessary, drying, is preferably subjected to a vacuum heat treatment to remove/reduce some of the contaminants prior to subjecting the composition to the elevated temperature and pressure conditions necessary for producing a polycrystalline CBN compact.

The composition typically comprises from about 80 volume % to about 95 volume % CBN. The CBN may be comprised of particles of more than one average particle size.

The binder phase typically includes one or more of phase (s) containing aluminium, silicon, cobalt, molybdenum, tantalum, niobium, nickel, titanium, chromium, tungsten, yttrium, carbon and iron. The binder phase may include powder with uniform solid solution of more than one of aluminium, silicon, cobalt, nickel, titanium, chromium, tungsten, yttrium, molybdenum, niobium, tantalum, carbon and iron.

The binder phase may contain a minor amount of carbide, generally tungsten carbide, which comes from the wear of the milling medium.

The average particle size of the CBN is usually no more than 12 μm and preferably no more than 10 μm.

In one form of the invention, the CBN particles are fine, typically no more than about 2 μm in size. For such fine particles it is preferred that only one particle size (unimodal) is used. The mixture preferably consists of only the binder phase and the CBN particles, with any other components such as tungsten carbide from the milling process, being present in minor amounts which do not affect the performance of the CBN compact which is produced from the mixture. In particular the mixture will be substantially free of any secondary hard phase.

When the CBN comprises particles of more than one average particle size, the CBN is preferably bimodal, i.e. it consists of particles with two average sizes. The range of the average particle size of the finer particles is usually from about 0.1 to about 2 μm and the range of the average particle size of the coarser particles is usually from about 2 to about 12 μm, preferably 2 to 10 μm. The ratio of the content of the coarser CBN particles to the finer particles is typically from 50:50 to 90:10. The coarser particles will preferably be greater than 2 μm in size. For such bimodal CBN particles it is preferable that the mixture also contains a secondary hard phase. The secondary had phase will preferably be present in an amount of no more than 75 percent by weight, more preferably no more than 70 percent by weight, of the combination of binder and secondary hard phase. In this form of the invention it is preferred that the binder phase and secondary hard phase together with the fine CBN particles, be attrition milled, the coarser CBN particles then added to this mixture and mixed using a method which does not involve attrition milling, e.g. high energy mixing such as mechanical stirring or ultrasonic stirring. The binder and secondary hard phases may be mixed and subjected to attrition milling, prior to the addition of the fine CBN particles.

Examples of suitable secondary hard phase materials are ceramic hard phases such as carbides, nitrides, borides and carbonitrides of a Group 4, 5 or 6 transition metal, aluminium oxide and mixtures thereof.

According to another aspect of the invention, a polycrystalline CBN compact is made by subjecting a powdered composition produced as described above to conditions of elevated temperature and pressure suitable to produce such a compact.

The powdered composition may be placed on a surface of a substrate, prior to the application of the elevated temperature and pressure conditions. The substrate will generally be a cemented metal carbide substrate.

DETAILED DESCRIPTION OF PREFERRED EMBODIMENTS

The present invention concerns the manufacturing of high CBN content abrasive compacts. The composition or starting material used in producing the polycrystalline CBN compact comprises CBN and a binder phase, in powder or particulate form. The binder phase should at least partially melt and react with CBN and form bonding by reaction sintering during high pressure and high temperature sintering. The CBN content of the powdered composition is at least 80 volume percent. The CBN content of the polycrystalline CBN compact produced from the powdered composition will be lower than that of the composition. Thus, the CBN content of the polycrystalline CBN compact produced from the powdered composition of the invention will be at least 75 volume percent.

Typically in a polycrystalline CBN compact, where the CBN exceeds about 75 percent by volume of the compact, there is a considerable amount of CBN-to-CBN contact and bonding. The CBN compact that has a CBN volume percent of greater than about 75 is typically characterised by isolated small binder phase between CBN grains. The binder phase in sintered compact is typically ceramic in nature and formed by reaction sintering between CBN and various metals that can form stable nitrides and borides. At least some of the binder phase material should be liquid or partially liquid during sintering and should wet CBN grains in order to achieve good bonding between CBN grains The size distributions of the binder phase ingredients are preferably carefully chosen in order to achieve as much binder phase homogeneity as possible so that there is an even distribution of binder phase between CBN grains. This provides the final material with isotropy of properties and increased toughness. Even dispersion of the binder phase tends to provide strong bonding which also tends to reduce ease of removal of CBN grains during machining by abrasive workpiece materials.

In the powdered composition produced by the invention, the CBN may contain multimodal particles i.e. at least two types of CBN particles that differ from each other in their average particle size. "Average particle size" means the major amount of the particles will be close to the specified size although there will be a limited number of particles further from the specified size. The peak in distribution of the particles will have a specified size. Thus, for example if the average particle size is 2 μm, there will by definition be some particles which are larger than 2 μm, but the major amount of the particles will be at approximately 2 μm in size and the peak in the distribution of the particles will be near 2 μm.

The use of multimodal, preferably bimodal, CBN in the composition, for larger CBN particle sizes, ensures that the matrix is finely divided to reduce the likelihood of flaws of critical size being present in the pre-sintered composition. This is beneficial for both toughness and strength in the compact produced from the composition.

Milling in general, as a means of comminution and dispersion, is well known in the art. Commonly used milling techniques used in grinding of ceramic powders include conventional ball mills and tumbling ball mills, planetary ball mills and attrition ball mills and agitated or stirred ball mills.

In conventional ball milling the energy input is determined by the size and density of the milling media, the diameter of the milling pot and the speed of rotation. As the method requires that the balls tumble, rotational speeds, and therefore energy are limited. Conventional ball milling is well suited to milling of powders of low to medium particle strength. Typically, conventional ball milling is used where powders are to be milled to final size of around 1 μm or more.

In planetary ball milling, the planetary motion of the milling pots allows accelerations of up to 20 g, which, where dense media are used, allows for substantially more energy in milling compared to conventional ball milling. This technique is well suited to comminution in particles of moderate strength, with final particle sizes of around 1 μm.

Attrition mills consist of an enclosed grinding chamber with an agitator that rotates at high speeds in either a vertical or horizontal configuration. Milling media used are typically in the size range 0.2 to 15 mm and, where comminution is the objective, milling media typically are cemented carbides, with high density. The high rotational speeds of the agitator, coupled with high density, small diameter media, provide for extremely high energy. Furthermore, the high energy in attrition milling results in high shear in the slurry, which provides for very successful co-dispersion, or blending of powders. Attrition milling achieves finer particles and better homogeneity than the other methods mentioned.

When the CBN consists of fine particles, typically 2 μm or less, then the CBN and binder phase are milled and mixed together by attrition milling with a controlled amount of wear of milling media. The binder phase may be subjected to attrition milling prior to the addition of the CBN particles.

When the CBN consists of particles of different sizes, where the coarse fraction is typically in the region of greater than 2 μm and 12 μm, the process usually consists of more than one step. The first step being the milling of the powdered binder phase and secondary hard phase, when present, with the fine fraction of CBN, in order to produce a fine mixture and the second step entails adding of coarser fraction of CBN. The mixture to which the coarse CBN particles have been added is then mixed using high energy mixing such as mechanical or ultrasonic mixing. There is no further attrition milling thus minimizing excessive introduction of carbide from the milling media. The binder phase with the secondary hard phase, when present, may be subjected to attrition milling prior to the adding of the fine CBN particles.

In the method of the invention, the binder phase particles are subjected to attrition milling in order to mechanically activate surfaces and optionally decrease particle size of binder phase materials. If the binder phase consists of more than one metallic phase, attrition milling can also provide limited amount of alloying formation, which further homogenize the chemistry of binder phase. The attrition milling of binder phase designed in such a way that wear of milling media, typically tungsten carbide is minimized.

Typical conditions of elevated temperature and pressure necessary to produce polycrystalline CBN compacts are well known in the art. These conditions are pressures in the range of about 2 to about 6 GPa and temperatures in the range of about 1100° C. to about 2000° C. Conditions found particularly favourable for the present invention fall within about 4 to 6 GPa and 1200 to 1600° C.

Compacts produced from the method of the invention have particular application in machining of grey cast iron, powder metallurgy (PM) steels, high chromium cast irons, white cast irons and high manganese steels. High CBN materials are used normally roughing and heavy interrupted machining operations. In certain cases they are also used in finish machining, such as finish machining of grey cast iron and powder metallurgy (PM) irons.

The invention will be illustrated by the following non-limiting examples:

EXAMPLES

Example 1

Attrition Milling

Cobalt, aluminium, tungsten powders, with the average particle size 1, 5 and 1 μm, respectively, were attrition milled with CBN. Cobalt, 33 wt %, aluminium, 11 wt %, and tungsten, 56 wt %, form the binder mixture. Cubic boron nitride (CBN) powder of about 1.2 μm in average particle size was added in to the binder mixture in an amount to achieve 92 volume percent CBN. The powder mixture was attrition milled with hexane for 2 hours using cemented carbide milling media. After attrition milling, the slurry was dried under vacuum and formed into a green compact supported by a cemented carbide substrate. After vacuum outgassing, the material was sintered at about 5.5 GPa and at about 1480° C. to produce a polycrystalline CBN compact. This CBN compact (hereinafter referred to as Material A) was analysed and then subjected to a machining test.

Example 2

Attrition Milling

Aluminium and tungsten powders, with the average particle size about 5 and 1 μm, respectively, were attrition milled with CBN. Aluminium, 30 wt %, and tungsten, 70 wt %, form the binder mixture. Cubic boron nitride (CBN) powder of about 2 μm in average particle size was added in to the binder mixture in an amount to achieve 94.5 volume percent CBN. The powder mixture was attrition milled with hexane for 2 hours using cemented carbide milling media. After attrition milling, the slurry was dried under vacuum and formed into a green compact supported by a cemented carbide substrate. After vacuum outgassing, the material was sintered at about 5.5 GPa and at about 1480° C. to produce a polycrystalline CBN compact. This CBN compact (hereinafter referred to as Material B) was analysed and then subjected to a machining test.

Example 3

Attrition Milling

Aluminium and cobalt powders, with the average particle size about 5 and 1 μm, respectively, were attrition milled with CBN. Aluminium, 30 wt %, and cobalt, 70 wt %, form the binder mixture. Cubic boron nitride (CBN) powder of about 2 μm in average particle size was added in to the binder mixture in an amount to achieve 93 volume percent CBN. The powder mixture was attrition milled with hexane for 2 hours using cemented carbide milling media. After attrition milling, the slurry was dried under vacuum and formed into a green compact supported by a cemented carbide substrate. After vacuum outgassing, the material was sintered at about 5.5 GPa and at about 1480° C. to produce a polycrystalline CBN compact. This CBN compact (hereinafter referred to as Material C) was analysed and then subjected to a machining test.

Example 4

Ball Milling

Cobalt, aluminium, tungsten powders, with the average particle size 1, 5 and 1 μm, respectively, were ball milled with CBN. Cobalt, 33 wt %, aluminium, 11 wt %, and tungsten, 56 wt %, form the binder mixture. Cubic boron nitride (CBN) powder of about 1.2 μm in average particle size was added in to the binder mixture in an amount to achieve 92 volume percent CBN. The powder mixture was ball milled with hexane for 10 hours using cemented carbide milling media. After ball milling, the slurry was dried under vacuum and formed into a green compact supported by a cemented carbide substrate. After vacuum outgassing, the material was sintered at about 5.5 GPa and at about 1480° C. to produce a polycrystalline CBN compact. This CBN compact (hereinafter referred to as Material D) was analysed and then subjected to a machining test.

According to X-ray diffraction analysis, the sintered materials, Materials A, B, C, and D contained phases of CBN, WC, CoWB, $CO_{21}W_2B_6$ and small amounts of AlN and $Al_2O_3$.

These materials were tested in continuous finish turning of K190™ sintered PM tool steel. The workpiece material contains fine Cr-carbides and very abrasive on PCBN cutting tools. The tests were undertaken in dry cutting conditions with the following cutting parameters:

| | |
|---|---|
| Cutting speed, vc (m/min): | 150 |
| Depth of cut (mm): | 0.2 |
| Feed, f (mm): | 0.1 |
| Insert geometry: | SNMN 090308 T0202 (edge radius, r0 = 10-15 j-im) |

All cutting tools from Materials A, B, C, D were tested to failure as a result of excessive flank wear. Flank wears were measured (as Vb-max) at least three different cutting distances and it was found that in general the relationship between flank wear and cutting distance is linear. Least-squares lines were drawn to each set of data points for each PCBN materials. The flank wear rates in μm per meter sliding distance for each example materials were calculated and results are summarized in Table 1.

TABLE 1

Flank wear rates of PCBN cutting tools

| Materials | Flank Wear Rate [μm/m sliding distance] |
|---|---|
| Material A: Attrition milling | 0.230 |
| Material B: Attrition milling | 0.214 |
| Material C: Attrition milling | 0.230 |
| Material D: Ball milling | 0.238 |

The three polycrystalline CBN compacts produced from a composition which had been attrition milled all had lower flank wear rates, indicating better performance due to longer cutting distance for a given total flank wear than the polycrystalline CBN compact produced from the ball milled material, Material D.

Example 5

$Ti(C_{0.5}No_{0.5})_{0.8}$ powder was mixed with Al and Ti powders using a tubular mixer, the weight percentage of $Ti(C_{0.5}N_{0.5})_{0.8}$, Al and Ti powders were 59%, 15% and 26%, respectively. The powder mixture was attrition milled for four hours with hexane. Cubic boron nitride (CBN) powder of 1.2 μm in average particle size was added in an amount to achieve 24 volume percent in the overall mixture and the mixture was further attrition milled for one hour. Cubic boron nitride (CBN) powder of about 8 μm in average particle size was added in a ratio to achieve 56 volume percent in the overall mixture. The overall CBN content of this mixture was therefore 80 volume percent. The mixture, in the form of a powder slurry, was dried and vacuum out gassed at about 450° C. The dried powder mixture was high energy shear mixed for 30 minutes and freeze dried. The granulated powder was then formed into a green compact and after further vacuum outgassing, the material was sintered at about 5.5 GPa and at about 1350° C. to produce a polycrystalline CBN compact. This CBN compact (hereinafter referred to as Material E) was then analysed.

Example 6

$Ti(C_{0.5}No_{0.5})_{0.8}$ powder was mixed with Al and Ti powders using tubular mixer, the weight percentage of $Ti(C_{0.5}N_{0.5})_{0.8}$, Al and Ti powders were 59%, 15% and 26%, respectively. The powder mixture was attrition milled for four hours with hexane. Cubic boron nitride (CBN) powder of 1.2 μm in average particle size was added in an amount to achieve 24 volume percent in the overall mixture and the mixture was further attrition milled for one hour. Cubic boron nitride (CBN) powder of about 4.5 μm in average particle size was added in a ratio to achieve 56 volume percent in the overall mixture. The overall CBN content of the mixture was therefore 80 volume percent. The mixture, in the form of a powder slurry, was dried and vacuum out gassed at about 450° C. and dried powder mixture was high energy shear mixed for 30 minutes and freeze dried. The granulated powder was formed into a green compact and after further vacuum outgassing, the material was sintered at about 5.5 GPa and at about 1350° C. to produce a polycrystalline CBN compact. This CBN compact (hereinafter referred to as Material F) was then analysed.

According to X-ray diffraction analysis, the sintered materials, Materials E and F contained phases of CBN, TiCN, WC and $Al_2O_3$.

The invention claimed is:

1. A method of making a powdered composition suitable for the manufacture of a polycrystalline CBN compact includes the steps of:

(i) subjecting a mixture of first CBN particles and a powdered binder phase to attrition milling;

(ii) adding second CBN particles having an average particle size coarser than that of the first CBN particles to the attrition milled mixture of step (i), producing a mixture in which the first and second CBN particles combined are present in an amount of at least 80 volume percent; and (iii) attrition milling the mixture of step (ii).

2. A method according to claim 1 wherein the combined CBN content of the mixture of step (ii) is in the range 80 volume percent to 95 volume percent.

3. A method according to claim 1 wherein the average particle size of the second CBN particles added in step (ii) is no more than 12 μm.

4. A method according to claim 1 wherein the average size of the second CBN particles added in step (ii) is no more than 10 μm.

5. A method according to claim 1 wherein the average particle size of the first CBN particles is from about 0.1 to about 2 μm and the average particle size of the second CBN particles added in step (ii) is from about 2 μm to about 12 μm.

6. A method according to claim 5 wherein the ratio of the content of the second CBN particles added in step (ii) to the fist CBN particles of step (i) is 50:50 to 90:10.

7. A method according to claim 1 wherein the mixture of step (i) further comprises a secondary hard phase.

8. A method according to claim 7 wherein the secondary hard phase is present in an amount of no more than 75 percent by weight of the combination of binder and secondary hard phase.

9. A method according to claim 7 wherein the secondary hard phase is present in an amount of no more than 70 percent by weight of the combination of binder and secondary hard phase.

10. A method according to claim 1 wherein the binder phase includes one or more phase(s) containing aluminium, silicon, cobalt, molybdenum, tantalum, niobium, nickel, titanium, chromium, tungsten, yttrium, carbon or iron.

11. A method of making a polycrystalline CBN compact including the step of providing a composition made by a method according to claim 1 and subjecting the composition to conditions of temperature and pressure suitable to produce the compact.

12. A method according to claim 11 wherein the conditions of temperature and pressure are a temperature in the range 1100 to 2000° centigrade and a pressure in the range of 2 to 6 GPa.

13. The method of claim 1, wherein a slurry mixture of step (i), or the mixture of step (iii), or the mixture of both steps (i) and (iii), comprises a hexane solvent.

14. The method of claim 1, wherein the attrition milling of step (i), or the attrition milling of step (iii), or both the attrition milling of steps (i) and (iii), is wet attrition milling.

* * * * *